US010221494B2

(12) United States Patent
Suarez Loira

(10) Patent No.: US 10,221,494 B2
(45) Date of Patent: Mar. 5, 2019

(54) HANGING BAR FOR ANODES WITHOUT LUGS

(71) Applicant: ASESORIAS Y SERVICIOS INNOVAXXION SPA, Santiago (CL)

(72) Inventor: Pablo Suarez Loira, Santiago (CL)

(73) Assignee: Asesorias Y Servicios Innovaxxion SpA, Santiago (CL)

( * ) Notice: Subject to any disclaimer, the term of this patent is extended or adjusted under 35 U.S.C. 154(b) by 47 days.

(21) Appl. No.: 15/324,117

(22) PCT Filed: Jul. 1, 2015

(86) PCT No.: PCT/IB2015/054961
§ 371 (c)(1),
(2) Date: Jan. 5, 2017

(87) PCT Pub. No.: WO2016/005858
PCT Pub. Date: Jan. 14, 2016

(65) Prior Publication Data

US 2017/0233882 A1 Aug. 17, 2017

(30) Foreign Application Priority Data

Jul. 8, 2014 (CL) ..... 1810-2014

(51) Int. Cl.
*C25C 7/02* (2006.01)
*C25C 1/12* (2006.01)

(52) U.S. Cl.
CPC . *C25C 7/02* (2013.01); *C25C 1/12* (2013.01)

(58) Field of Classification Search
CPC ..... C25C 7/00; C25C 7/02; C25C 7/025
(Continued)

(56) References Cited

U.S. PATENT DOCUMENTS 3,198,669 A 8/1965 Pickering
4,792,129 A * 12/1988 LePrevost, Jr. ..... B25B 5/10 269/156

FOREIGN PATENT DOCUMENTS

CA 1095841 A1 2/1981
EP 0284128 A1 9/1988
(Continued)

OTHER PUBLICATIONS

International Search Report, PCT/IB2015/054961, dated Apr. 11, 2015.

*Primary Examiner* — Alexander W Keeling
(74) *Attorney, Agent, or Firm* — Tolpin & Partners, PC; Thomas W. Tolpin

(57) ABSTRACT

A hanging bar for supporting an anode (10) without lugs which is formed by a first lower portion of the body (11) and a second upper hanging portion (12) which comprises: two elongated splints (15) having a width similar to said second upper hanging portion (12); two plastic spacer pieces (33) connecting the ends of said two splints (15) being each one of said two plastic spacer pieces (33) formed by a base (28) from which two pillars (20) emerge, leaving between both pillars (20) a central housing zone (34), wherein on said base (28) and between said pillars (20) there is a planar surface (31) and on the inner portion of said base (28) there is an inclined surface (30), two pivoting supports (17), being each one of them housed in the central housing (34) of said two plastic spacer pieces (33), wherein said pivoting supports (17) are formed by a straight piece (43) which finishes in one of its ends in a bushing (27) in the center of which has a first hole (39) which matches second holes (38) of said pillars (20) and third holes (40) of said elongated splints (15) in such a way that within the holes (38, 39, 40) a short axis (21) is housed wherein said pivoting supports (17) pivot; and a pair of pivoting lugs (16) which are supported by said
(Continued)

pivoting supports (17) being each pivoting lug (16) formed by a first elongated portion (36) and a second short portion (37) integrally connected to each other at 90° providing an L shape wherein said first portion (36) has first toothed notches (26) and wherein said second short portion (37) has second toothed notches (25).

6 Claims, 19 Drawing Sheets

(58) Field of Classification Search
USPC ..... 269/86–286, 40; 204/297.01–297.16
See application file for complete search history.

(56) References Cited

FOREIGN PATENT DOCUMENTS

| | | | | | |
|---|---|---|---|---|---|
| GB | 1445994 | A | | 8/1976 | |
| WO | WO 2000/0039366 | A1 | | 7/2000 | |
| WO | WO 2013/038352 | A1 | | 3/2013 | |
| WO | WO-2013038352 | A1 | * | 3/2013 | ..... C25C 1/12 |
| WO | WO 2014/068410 | A1 | | 5/2014 | |
| WO | WO 2016/005858 | A1 | | 1/2016 | |

* cited by examiner

HANGING BAR FOR ANODES WITHOUT LUGS

TECHNICAL FIELD OF THE INVENTION

The present invention relates to an anode without lugs (ears) to be used together with a hanging bar having pivotable lugs (ears) and a system formed by said anode and said hanging bar, as well as a mounting method.

This invention makes possible the use of an anode without lugs which allows reducing the production of scrap along with its subsequent associated costs.

BACKGROUND OF THE INVENTION

The process of producing high purity copper involves several stages, starting with the receiving and sampling of copper concentrates. It is important to perform a sampling thereof and classify them according to the copper, iron, silica concentration as well as impurities such as mainly arsenic, antimony and zinc.

Subsequent to the classification, the concentrate enters the drying stage where the humidity is reduced from 8% to 0.2% then the dried concentrate enters the smelting process whose objective is achieving the change of state which allows that the concentrate passes from a solid state to a liquid state in order for the copper to be separated from the other elements that are part of the concentrate.

The copper concentrate fusion is the result of the instantaneous self-ignition thereof which takes place at high temperatures (greater to 1200° C.). In this process the concentrate passes from the solid state to the liquid state. The elements that are part of the ores that are present in the concentrate are separated according to its weight leaving the lightest ones on the upper part of the molten metal which is referred to as scrap which are mainly iron and silica rich-phases, while the copper associated to the sulphur which is heavier, is concentrated in the lower part of the reactor which is called white metal or matte.

In this way, it is possible to separate both parts by removing them from the reactor by means of bleed-of passages located at different levels.

The fusion furnaces or reactors must be constantly loaded and need permanently to be bled off. The rich-copper material is conveyed in liquid form through pots or chutes to the conversion process where a copper-rich phase is produced which is called blister copper (98.5%), this product is subsequently taken in liquid form through pans or channels to a refining process where the main impurities such as dissolved sulphur, dissolved oxygen, and impurities such as arsenic, antimony, bismuth, lead and others are eliminated, in a way that the product finally obtained is anode copper with an overage purity of 99.5% of copper.

The anode copper is molded and solidified with a rectangular geometry, forming an anode plate (1) with lugs (2) as shown in FIG. 1.

The most used shape to mold an anode copper is by means of a casting wheel which has a determined quantity of copper molds wherein the copper is poured at a temperature lower or equal to 1200° C., once the cooper is cast into the casting wheel, this starts rotating and the molten copper begins to cool off in a first stage at an ambient temperature until the upper part of the copper is solid. Subsequently, the copper passes through a cooling section which has an upper and lower water cooling portions and in this section the copper reduces its temperature until being in a complete solid state to be taken to the electrolytic refining plant so as to produce a high-purity cathode having concentrations higher or equal to 99.9% in copper.

The anode copper is formed by a mold (7) which has a central cavity (8) of rectangular shape to receive the liquid copper which forms the anode plate (1). In the upper part of said mold (7), and towards the corners of the central cavity (8) are located two cavities (9) to receive the liquid copper which forms the lugs (2) as shown in FIGS. 6 and 7.

In refineries, the anode (1) is introduced in an electrolytic cell (3) which has a cathode (4) and can be a permanent cathode or mother sheet depending on the technology to be used, together with its hanging bar (5). The electrolytic cell (3) is filled with an acid solution and electricity is applied to the contacts (6) in order to produce the copper electroplating from the anode (1) to the cathode (4) as shown in FIGS. 2 to 5. In this process, the anode (1) is only submerged up to the continuous zone of the lugs (2), therefore, the upper part of the anode (1) does not participate in the electrolysis as shown in more detail in FIG. 3, using the lugs (2) only for the transport thereof and for the electrical contact.

At the end of the electrolytic cycle, this part of the anode remains intact and it becomes an important part of the rest of the anode, together with the undissolved material, which is called scrap. This material has to be smelted again in order to form a new anode (1) and to continue the complete cycle. This product is formed in all the existing refineries and the processing cost is high and said processing is performed by means of different existing technologies available in the market.

The present invention proposes a new geometric shape of the anode (1) which can separate the lugs (2) from the body of the anode, by keeping a rectangular configuration or another shape with the dimensions requested by the electro-refining technology to be used. Subsequently, and downstream of the molding process, a fastening system must be incorporated which is already factory-dimensioned and standardized according to the geometrical dimensions used by the existing electro-refining technologies.

The fastening system can consist of materials resistant to the acid solution used in the electro-erosion and will have conductors which will allow transmitting the electric current to the modified anode in a such a way that the electric contact is appropriate for the electrolysis process.

Several attempts have been made in the state of the art in order to generate bars with lugs for hanging cathodes and anodes in different process within the obtaining of non-ferrous metals.

Thus, for instance, document EP 0284128 published on Sep. 28, 1988 discloses a suspension bar for an anode or cathode sheet in electrolytic refining of metals wherein the core of the suspension bar consists of a material which exhibits a high resistance to bending and a high mechanical resistance, and is surrounded by a sheath of a material with good electrical conducting properties.

This material with good electrical conduction properties is for example copper, wherein near at least one of the ends of the suspension bar, and preferably near both ends, over a length of a least 3 cm and at most 5 cm, the sheath is continuous to the end of said core part. Also, this document discloses a method for manufacturing a suspension bar in which a sheath of copper is formed over a core of steel, starting from a copper tube.

The copper and steel cores are introduced into a copper tube, wherein subsequently the sheath is drawn, with further cores being added, to a total length which essentially corresponds to the change in length of the copper tube occurring as a result of the drawing and, finally, the rod produced is sawn up into the desired length at the points where the copper cores are located. Towards the center, the bar has two hooks to suspend an anode or cathode as the case may be.

Document ES 8303548 (Prengaman et al) discloses a method for the manufacture of a lead anode for the electrolytic extraction of metals.

The lead anode is used in the electrolytic extraction of metals and comprises a sheet of lead anode material provided with one or more recesses on the surface of a lead-tin alloy coated copper bus bar in the slot of which is placed a sheet of lead anode material of one solder that joins the mentioned sheet to the bus bar and of deposits of lead alloy which join the existing joints between the mentioned sheet and the cited bus bar. The solder comprises a lead-tin-silver alloy to be applied in the electrowinning of copper, nickel and zinc.

Document CA 1095841 (Huppi) published on Feb. 17, 1981 discloses an electrode hanger of unitary construction for an electrostatic precipitator having means on the upper end thereof for engaging with a current carrying support means and means on the lower end thereof for receiving an electrode thereon.

Document WO 2000/39366 (Prengaman) published on Jul. 6, 2000 discloses a method of manufacturing an electrowinning anode comprising: adjusting a sheet of lead alloy in a slot in a bus bar; b) holding the bus bar on the sheet; c) electrowining a lead coating on a bus bar; the pin and joint to form a metallurgical bond around the bus bar, pin and joint between the sheet and the bus bar.

None of the documents aforementioned discloses a system proposing a new geometrical shape of the anode with independent fasting means which make possible using said anode without lugs thereby reducing the production of scrap, allowing an enhancement of the process between the smelting and the electro refining.

On the other hand, document WO 2013/038352 A1, property of the same applicants, discloses a system comprising an anode hanger means and an enhanced geometry anode which makes possible to reuse said anode hanger means minimizing the production of scrap, allowing an enhancement of the process between the smelting and the electro-refining wherein said hanger means is formed by a reusable solid central bar to be located on the upper edge of the enhanced geometry anode wherein said reusable solid central bar has on its ends reusable ears having engagement means which take the enhanced geometry anode on its upper corners wherein in the upper corners of said enhanced geometry anode emerge two small upper projections wherein said hanger means comprises a reusable independent central bar wherein on the ends of said reusable independent central bar are fitted two reusable independent ears which have fastening means formed by a lower notch on which the upper projection of the enhanced geometry anode is housed.

This anode and hanger bar system disclosed in document WO 2013/038352 A1 is formed by a solid central bar which must be juxtaposed on the upper edge of the anode so as the independent ears are slid into a female slot and a male rim to form a tongue and groove joint member that makes possible as a rail the joint between the reusable independent central bar and said reusable independent ears. The reusable independent ears are displaced by said rail from the ends of the reusable independent central bar until said reusable independent ears are fitted into the upper small projections on the anode, thereby generating the closure of the system and securing the anode to the hanger means.

The mounting system between the hanging bar and the enhanced geometry anode results quite complex for the operations performed in the plant.

After the anode has been removed from the mold, this must be transported to the mounting zone of the hanging bar. The reusable independent central bar must be juxtaposed and contacted with the upper edge of the anode so as the independent ears are slid on said reusable independent central bar until being fitted with the small projections of the anode and thus closing the system in such a way that the anode and the hanging bar are transported towards the electro-refining process.

Due to the aforementioned, a first object of the present invention is providing a hanging means formed by an independent hanging bar and pivotable lugs connected to each other in such a way the anode mountings results easy.

A second object of the present invention is providing a design of anode which allows it to be resistant to the conveying process between the smelting and refining process in such a way it has a uniform thickness and volume which enhance the benefits of molding and cooling thereby avoiding twists. Thus, producing an anode of better quality.

A third object of the present invention is providing an anode which is designed to be completely submerged below the electrolyte.

A fourth objet is providing a design of an anode which by itself operates the pivotable lugs so these can pass from the open position to a closed position.

A fifth object of this invention is providing a mounting method for an anode on a hanging means with pivotable lugs in such a way the anode is fixed on said hanging means so as it can secured and ready to be conveyed and introduced into an electrolytic cell.

SUMMARY OF THE INVENTION

The present invention relates to a system of reusable lugs for the copper anodes which allows hanging these electrodes in order to be conveyed between the smelting and electro-refining processes which prevents the anodes from smelting its own lugs, thereby generating a change in the geometry enhancing the process wherein the amount of scrap is reduced.

The system of the invention is formed by an anode with a special geometrical shape and a set of reusable pieces which are generated in an independent way and introduced as a system into stages subsequent to the molding process of anode copper.

The essence of the invention lays in the assembly system which allows the operational handling of the anode copper, thereby allowing an efficient conduction of the current and incorporating technological elements which generate relevant information from the process.

The anode is characterized for not having lugs and being only wider in the upper part to be fitted and locked in the structure formed by the pivotable lugs (ears).

This anode is inserted into the hanging bar from above and remains firmly fitted by the pivotable lugs.

The structure of the hanging means comprises two steel plates having holes which allow the circulation of the electrolyte and supporting on each end the copper contacts that act as electrical conductor and support between the busbar of the cell and the body of the anode.

Besides, it has plastic separators which allow keeping a uniform distance among the anode and cathodes and in turn it acts as an electrical insulator.

The lugs are provided as a pivoting means having a leverage principle which allows taking advantage of the weight of the anode itself in order to multiply the tightening force on the upper face of the anode.

In this way, a great pressure is obtained which guarantees an optimal electrical conduction between the busbar and the body of the anode, thereby making easier the mounting of the anode on the hanging means.

The lugs have a mechanized contact with the shape of teeth which allow the quality of the electrical contact with the upper side edges of the anode.

BRIEF DESCRIPTION OF THE FIGURES

The figures attached are included in order to provide a better understanding of the invention, and constitute a part of this specification and also they illustrate part of the previous art and of some preferred embodiments so as to explain the principles of this invention.

DESCRIPTION OF THE INVENTION

The present invention relates to an anode without lugs to be used together with a hanging bar having pivotable lugs and a system conformed by said anode and said hanging bar, as well as a mounting method of the anode on the hanging bar.

Figure 1:
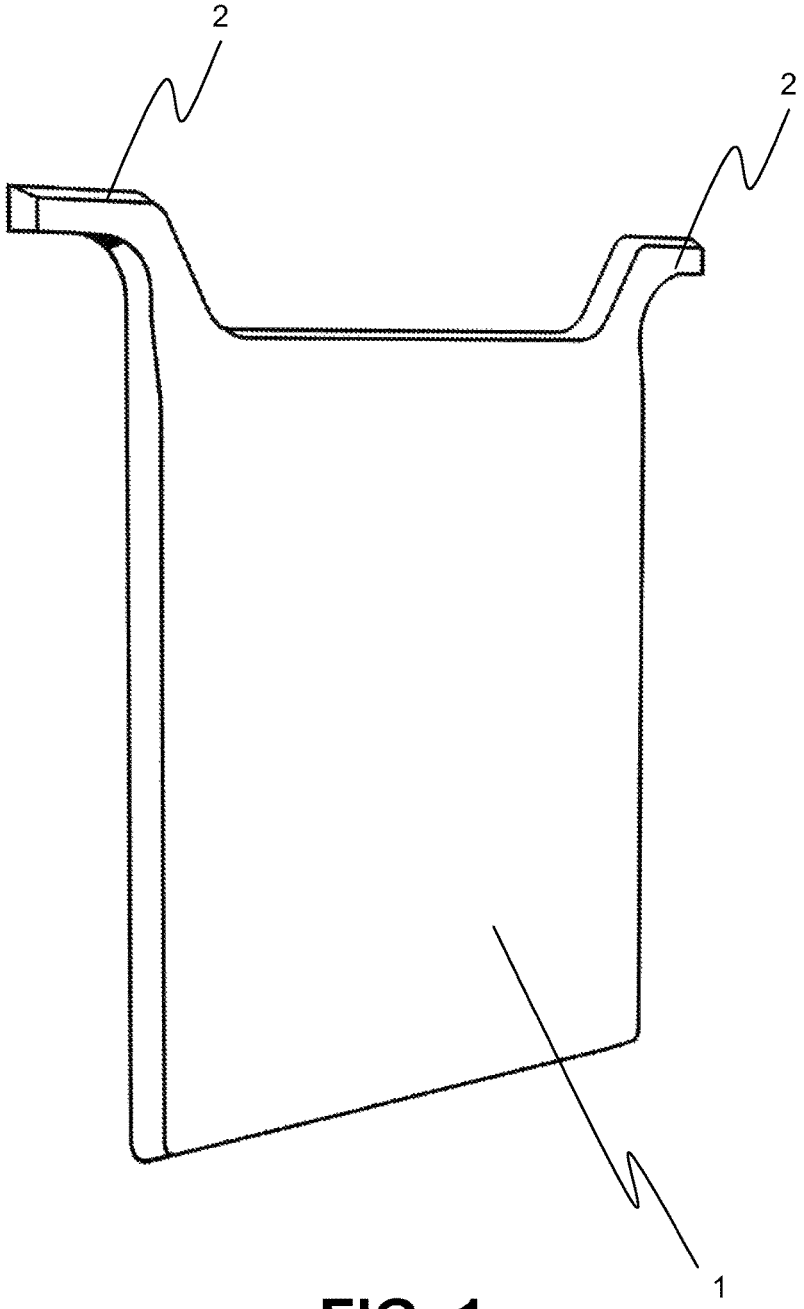
FIG. 1 PRIOR ART
FIG. 1 shows a perspective view of an anode of the previous art.
Figure 2:
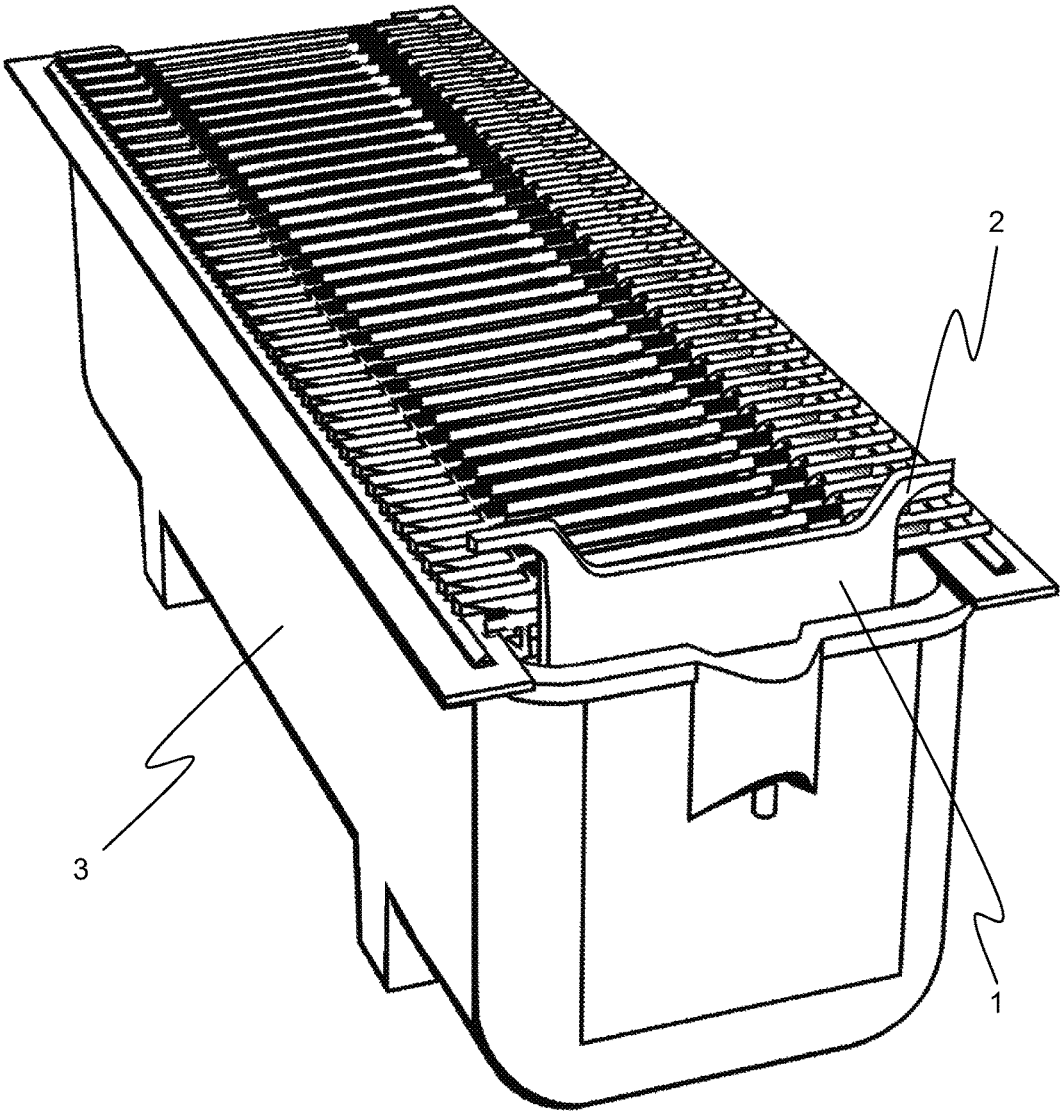
FIG. 2 PRIOR ART
FIG. 2 shows a perspective view of an electrolytic cell with the anode and cathode inserted in it from the previous art.
Figure 3:
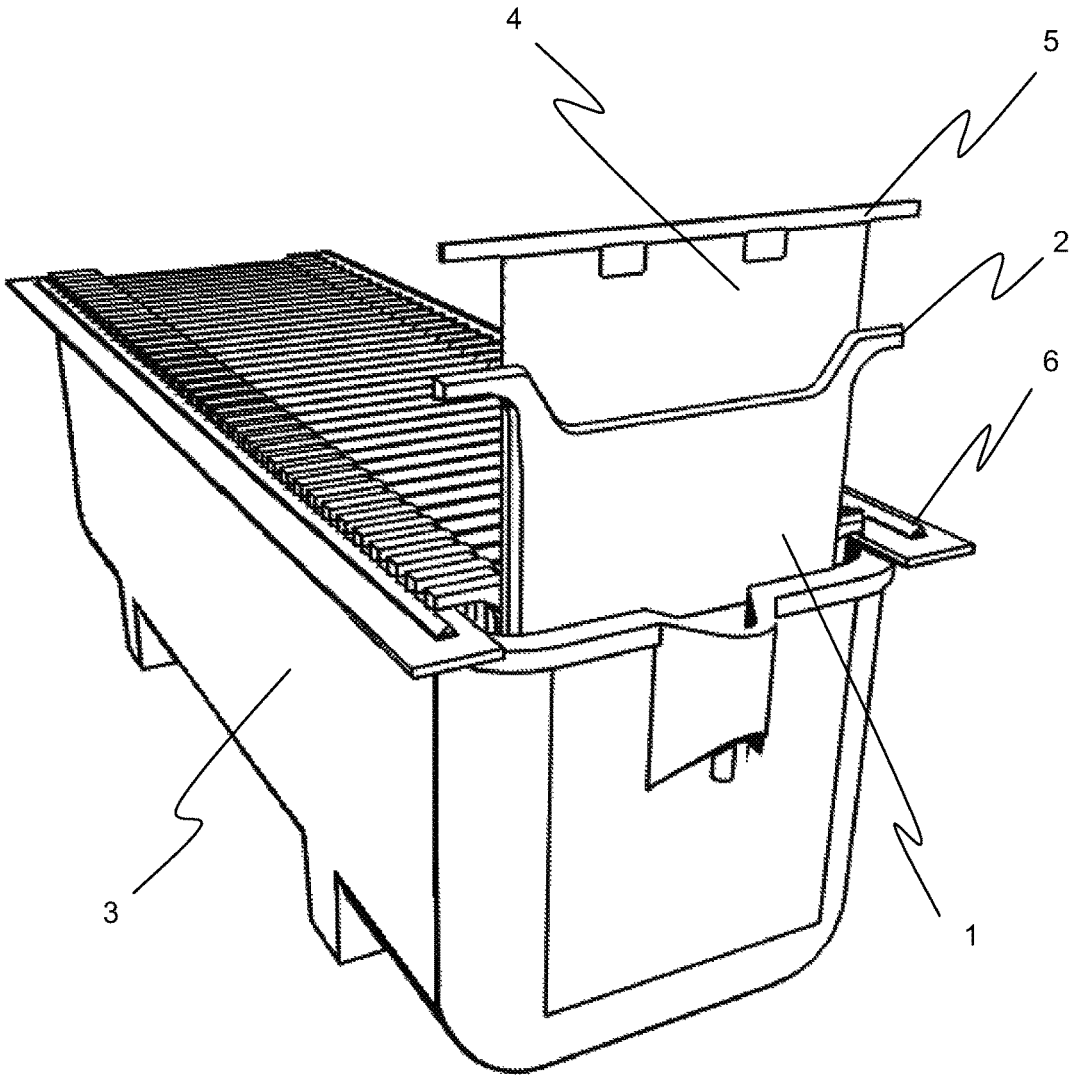
FIG. 3 PRIOR ART
FIG. 3 shows a perspective view of an electrolytic cell with the anode and cathode suspended over the acid solution (electrolyte) from the previous art.
Figure 4:
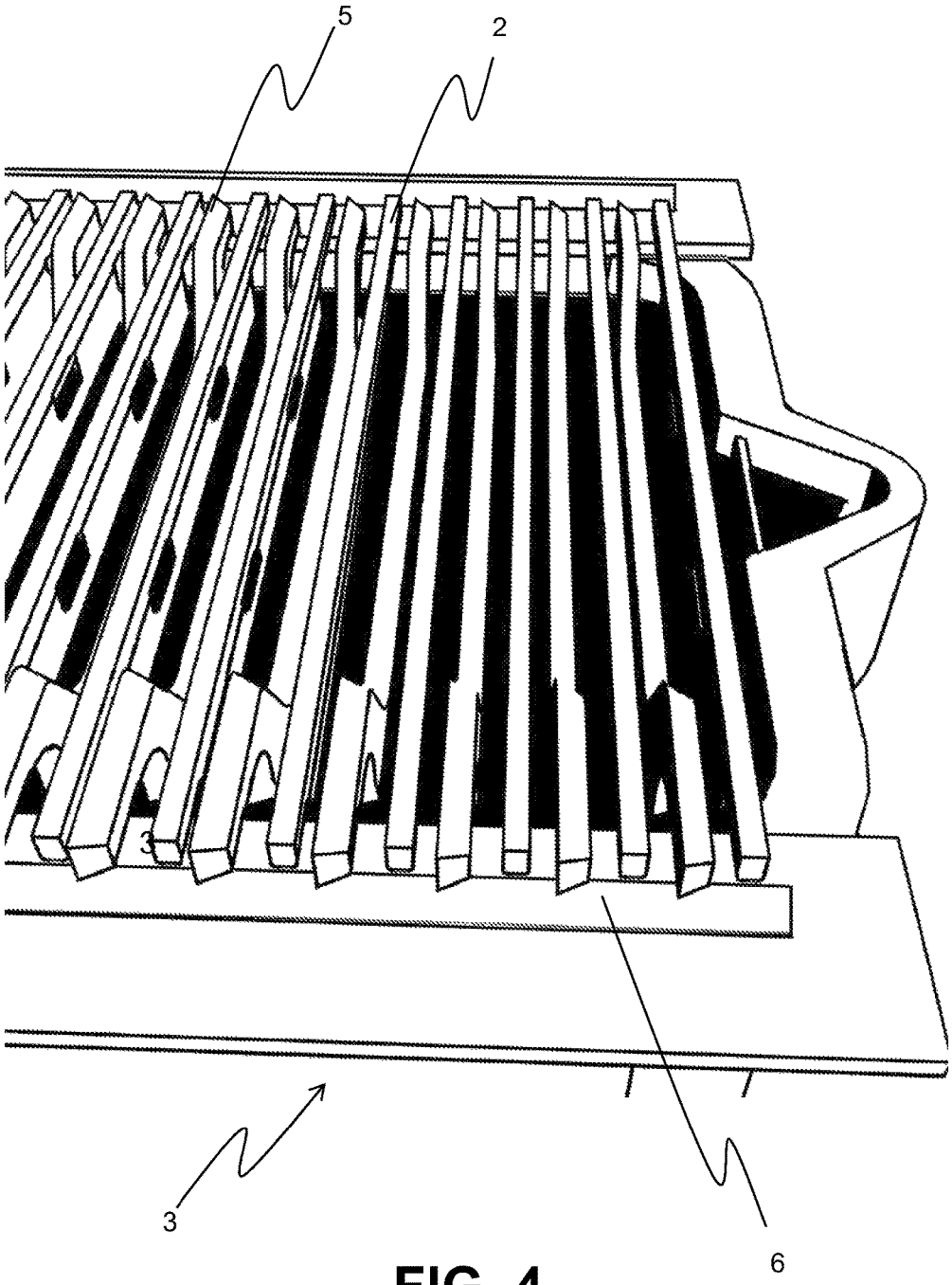
FIG. 4 PRIOR ART
FIGS. 4 and 5 show a perspective view of an electrolytic cell with the anodes and cathodes submerged in the acid solution (electrolyte) according to the previous art.
Figure 5:
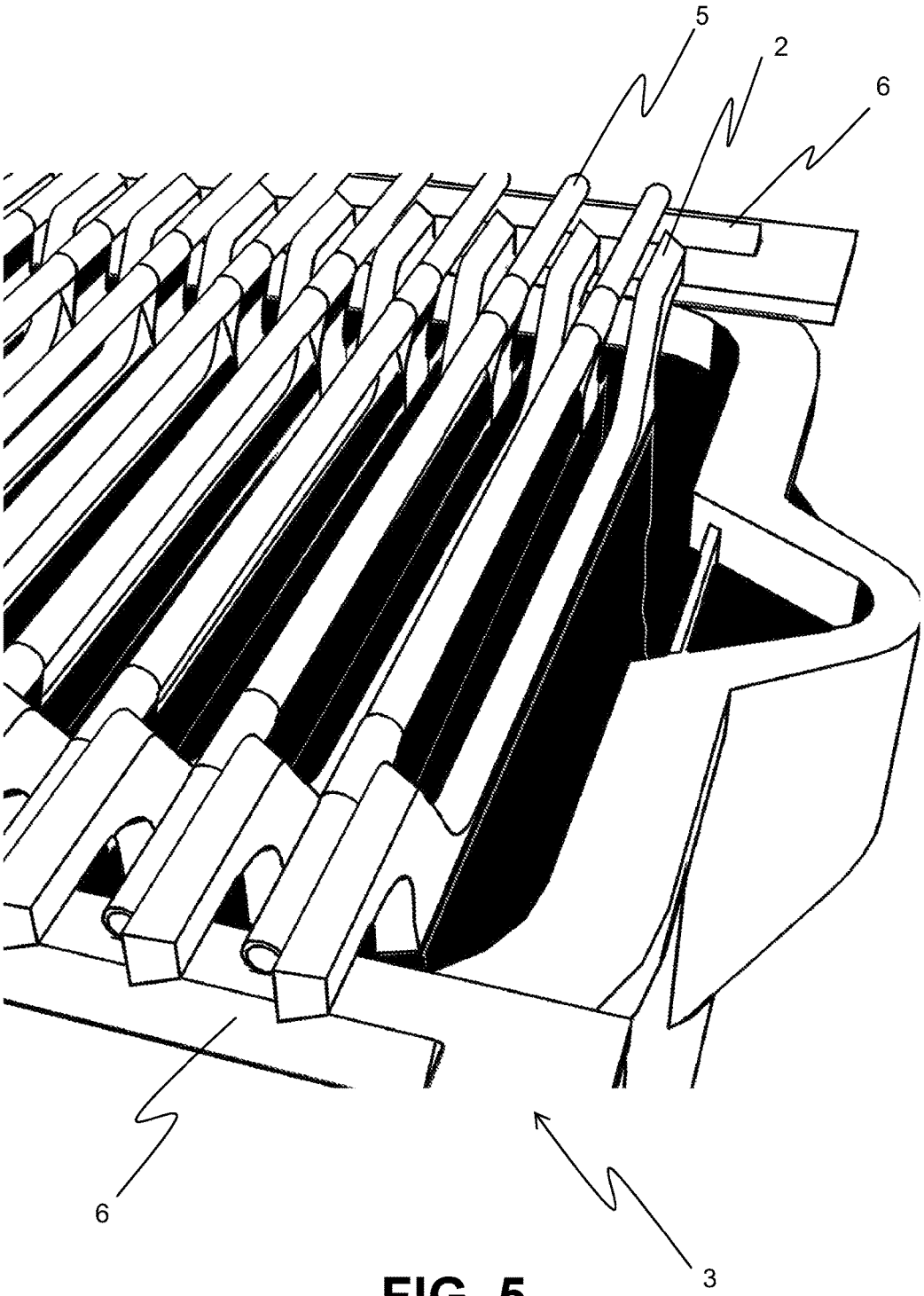
FIG. 5 PRIOR ART
Figure 6:
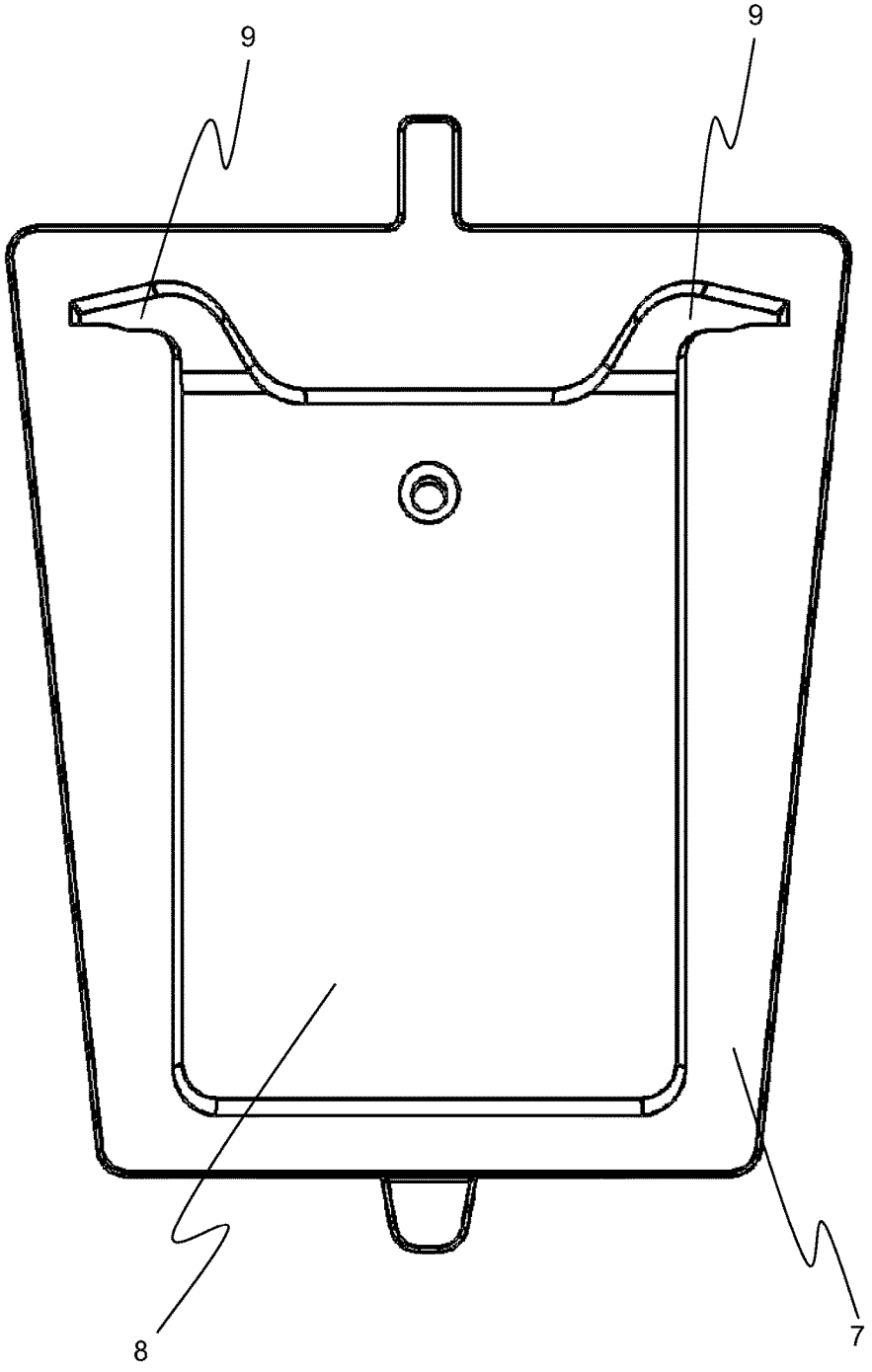
FIG. 6 PRIOR ART
FIG. 6 shows a front elevation view of a casting mold in order to form the anode of the previous art.
Figure 7:
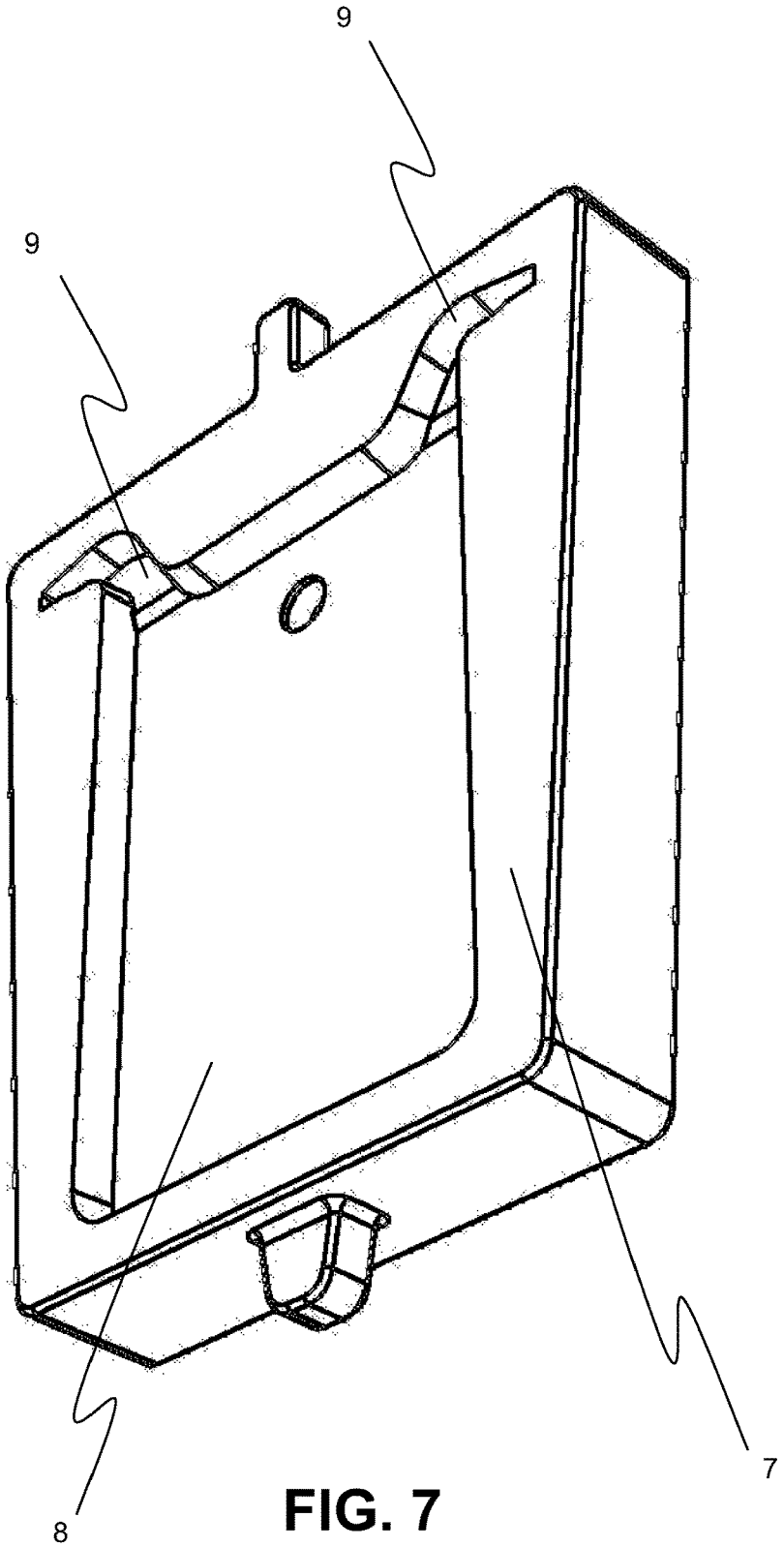
FIG. 7 PRIOR ART
FIG. 7 shows a perspective view of a casting mold in order to form the anode of the previous art.
Figure 8:
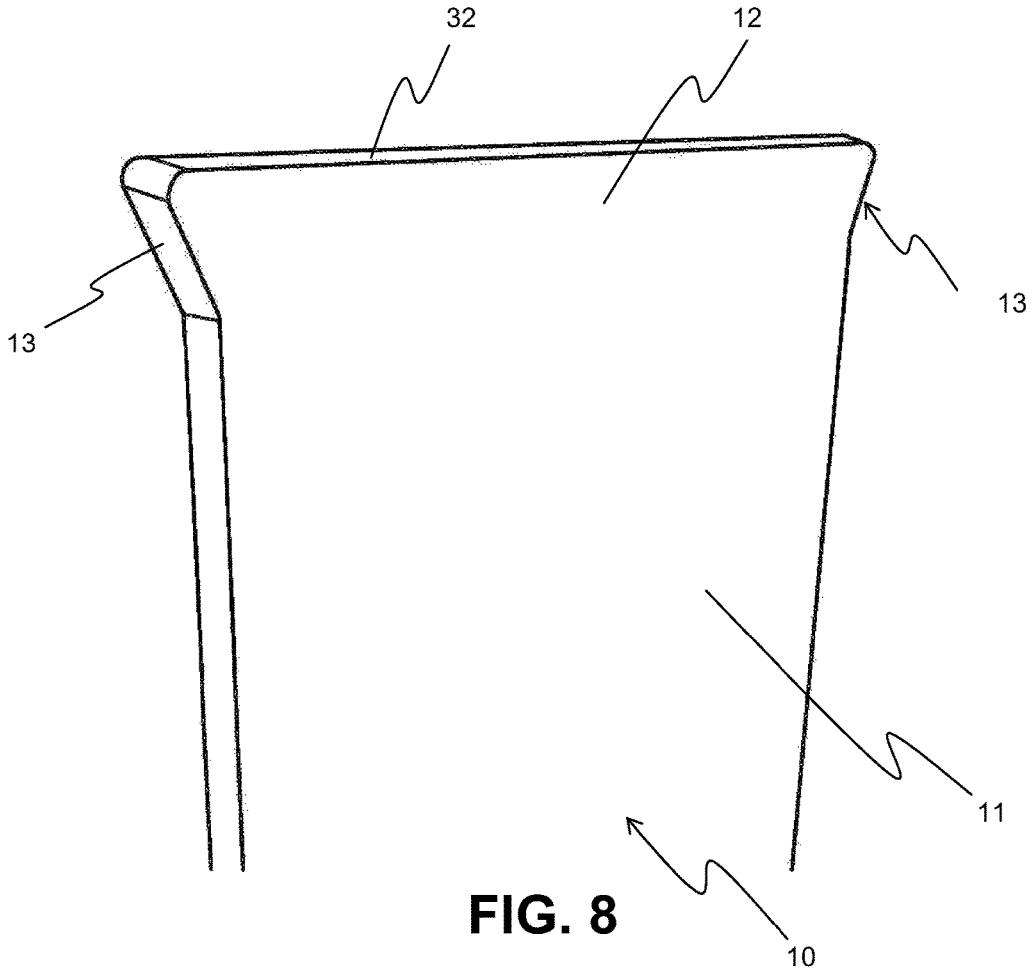
FIG. 8 shows a perspective view of an anode of the present invention.
Figure 9:
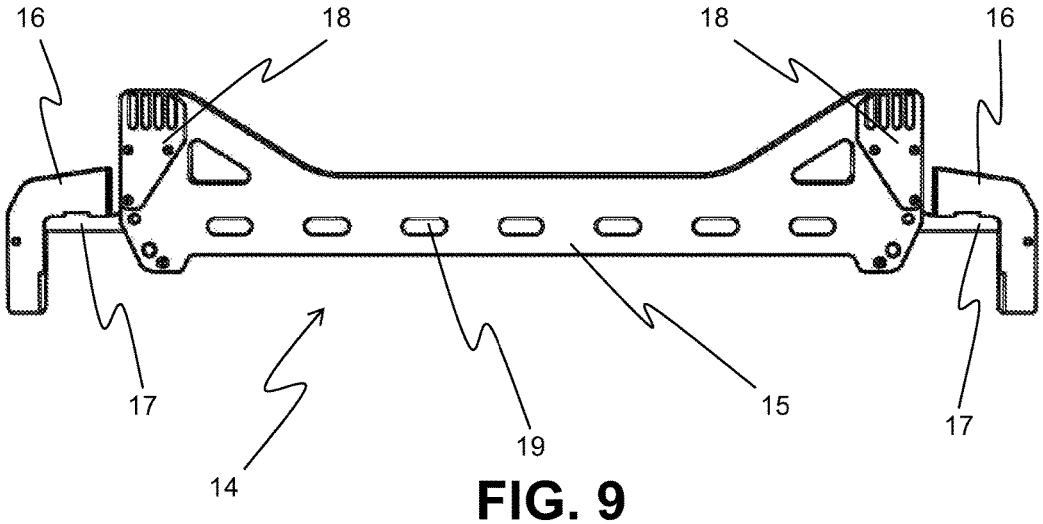
FIG. 9 shows a front view of the anode hanging bar of the present invention.
Figure 10:
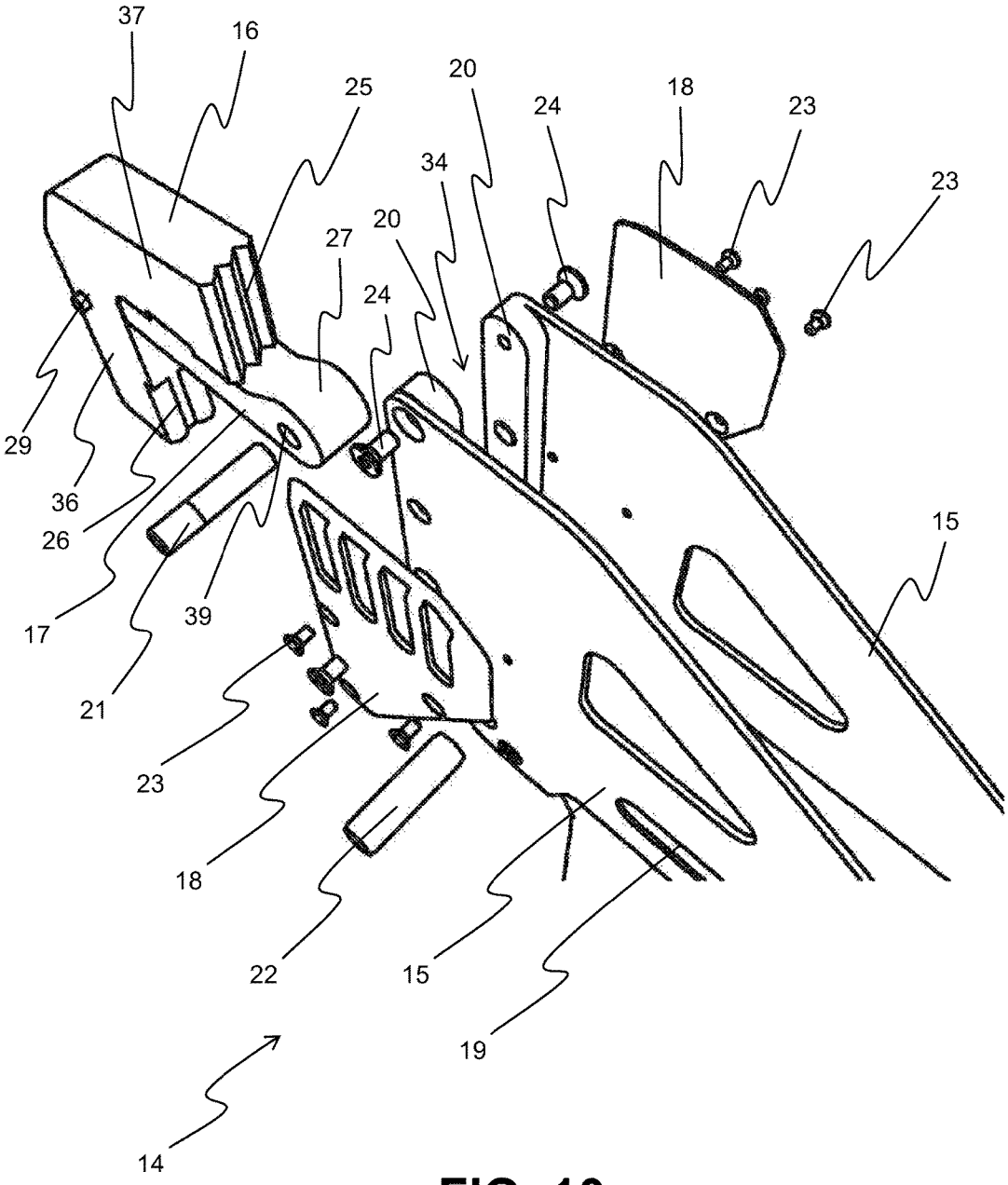
FIG. 10 shows an upper exploded perspective view of the end of the hanging bar of the present invention with the components of the lug of said bar.
Figure 11:
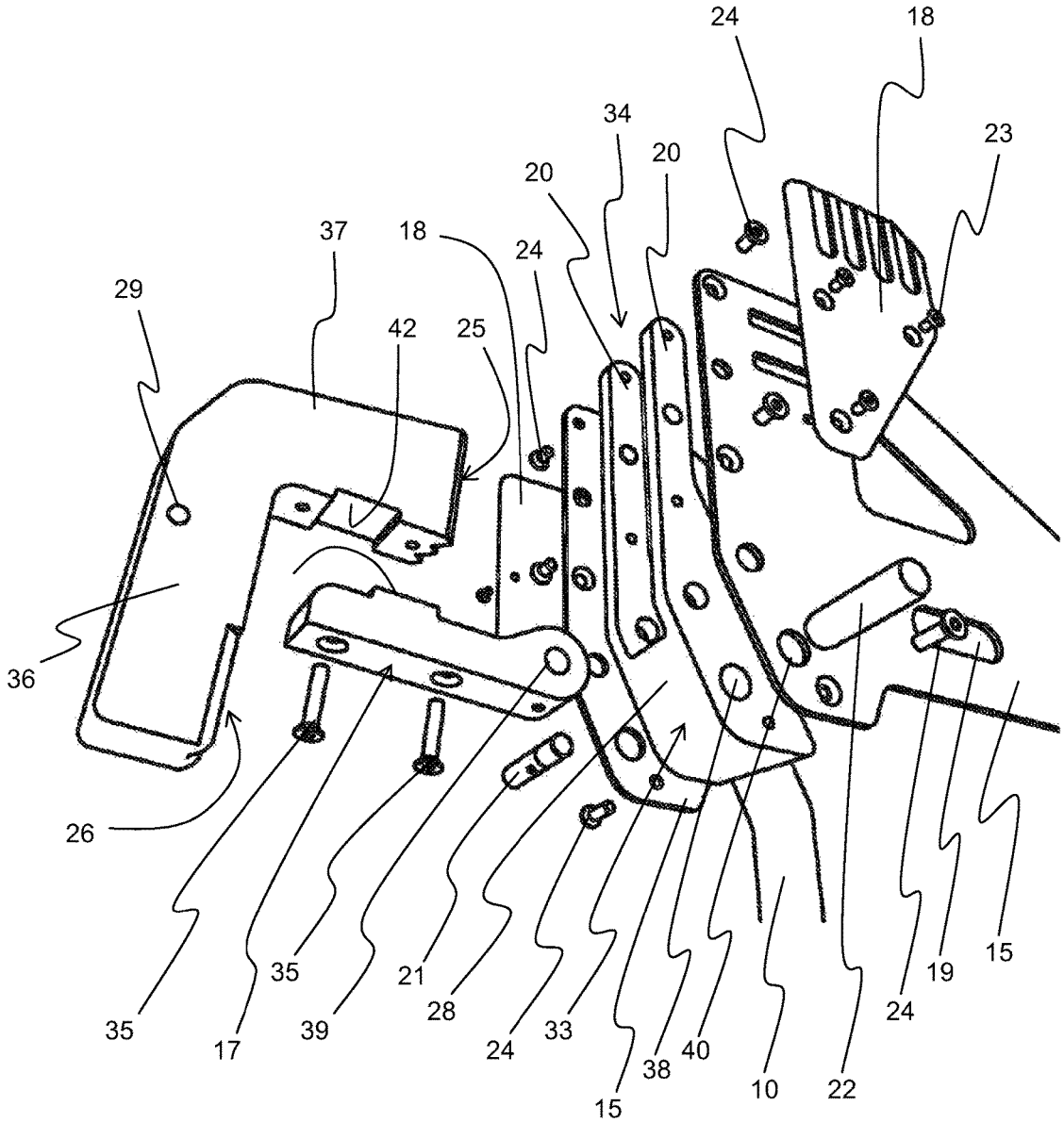
FIG. 11 shows a lower exploded perspective view of the end of the hanging bar of the present invention with the components of the lug of said bar.
Figure 12:
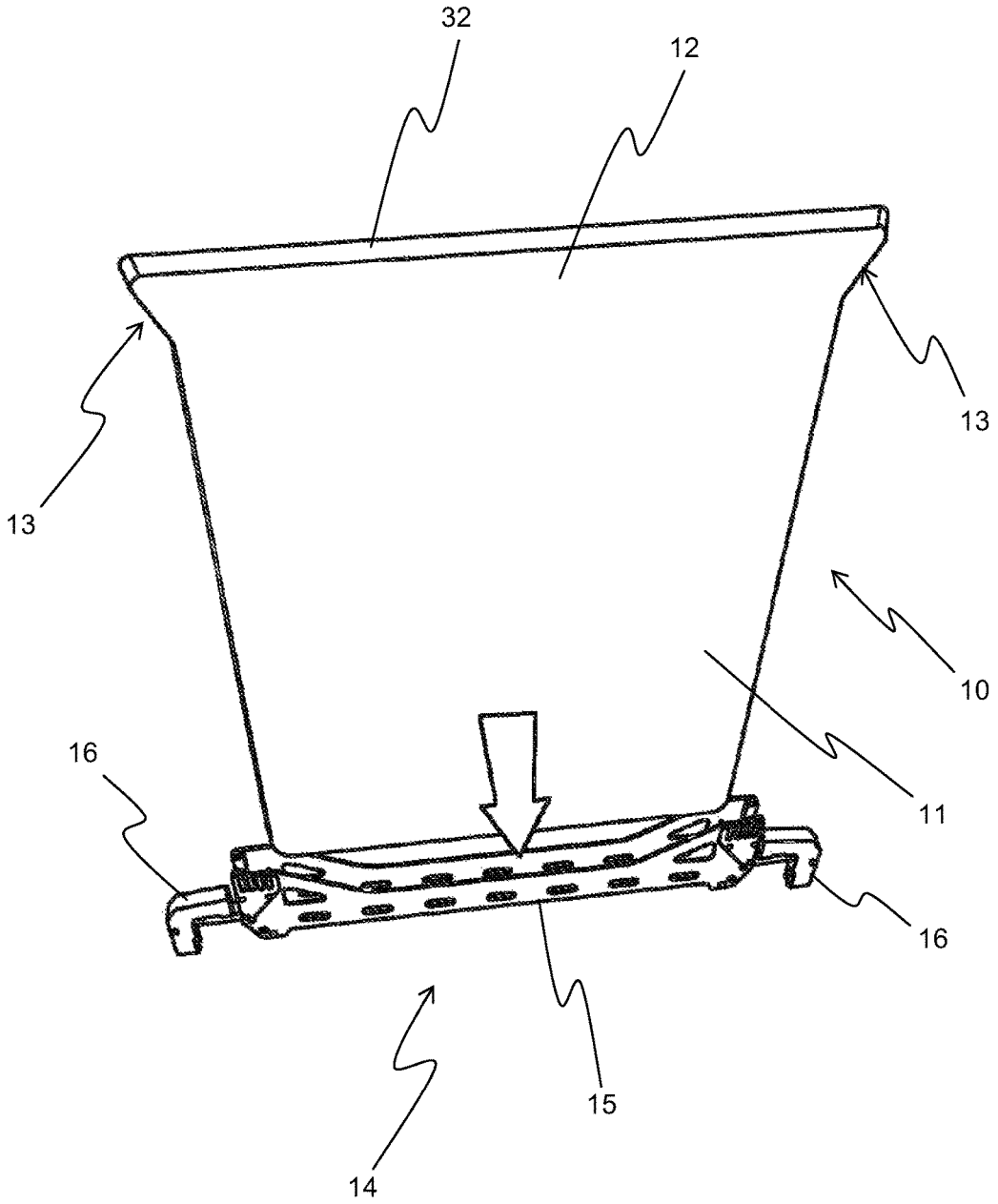
FIG. 12 shows an upper perspective view of the insertion of the lower portion of an anode of the present invention into a hanging bar of the present invention.
Figure 13:
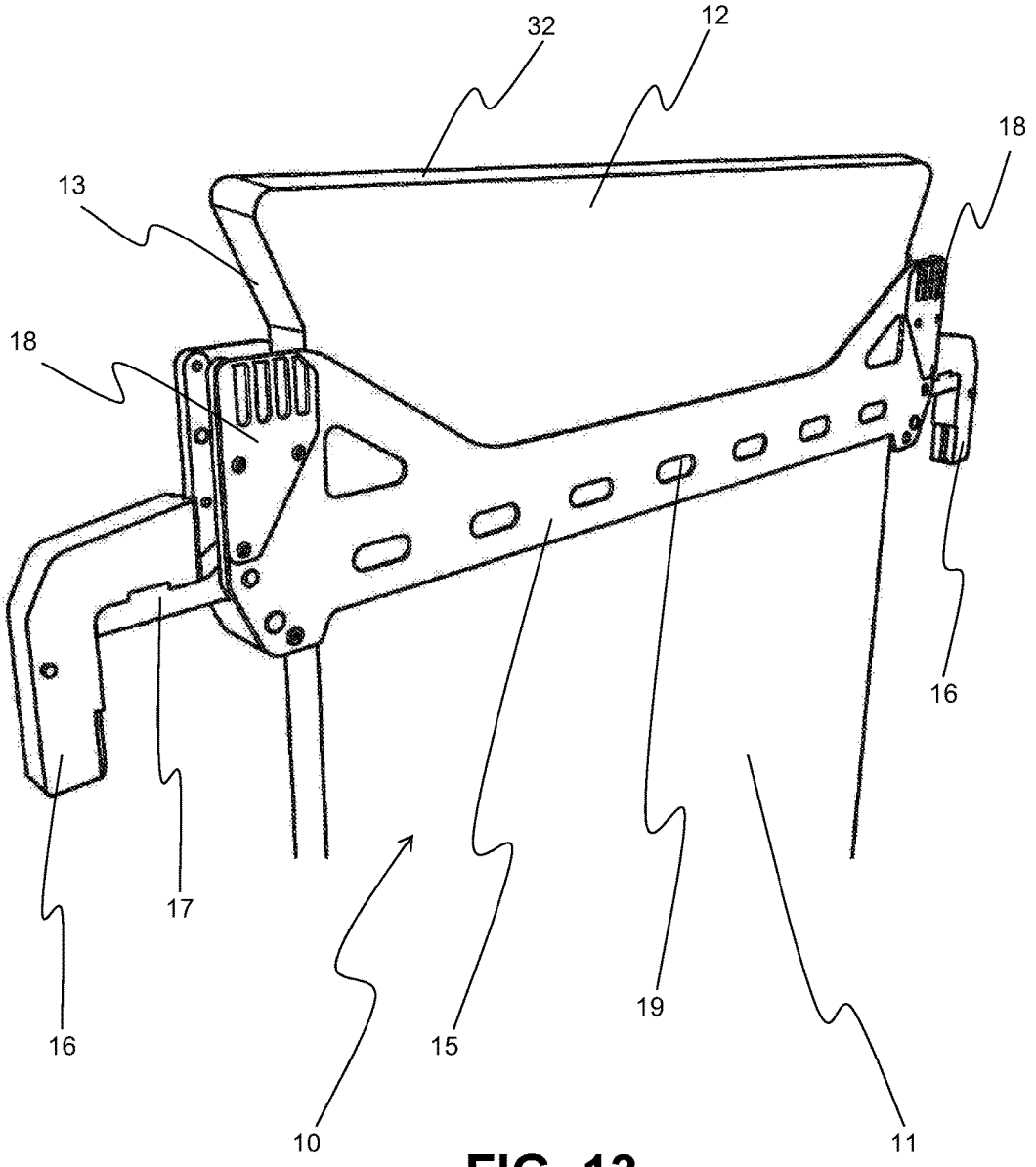
FIG. 13 shows an upper perspective view of the insertion of the middle portion of an anode of the present invention into a hanging bar of the present invention.
Figure 14:
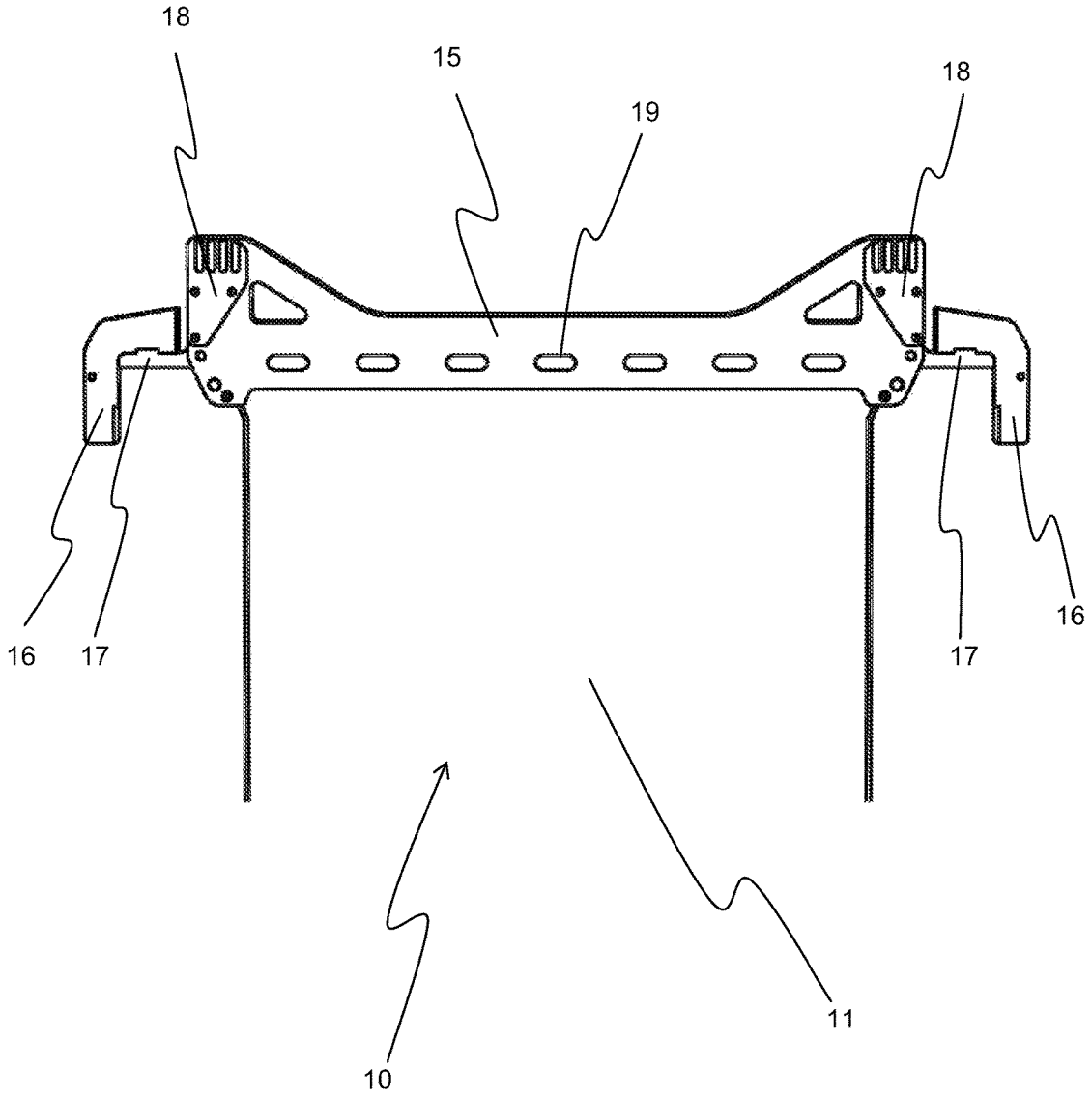
FIG. 14 shows an upper perspective view of the complete insertion of an anode of the present invention into a hanging bar of the present invention wherein the bar has the lugs in an open position.
Figure 15:
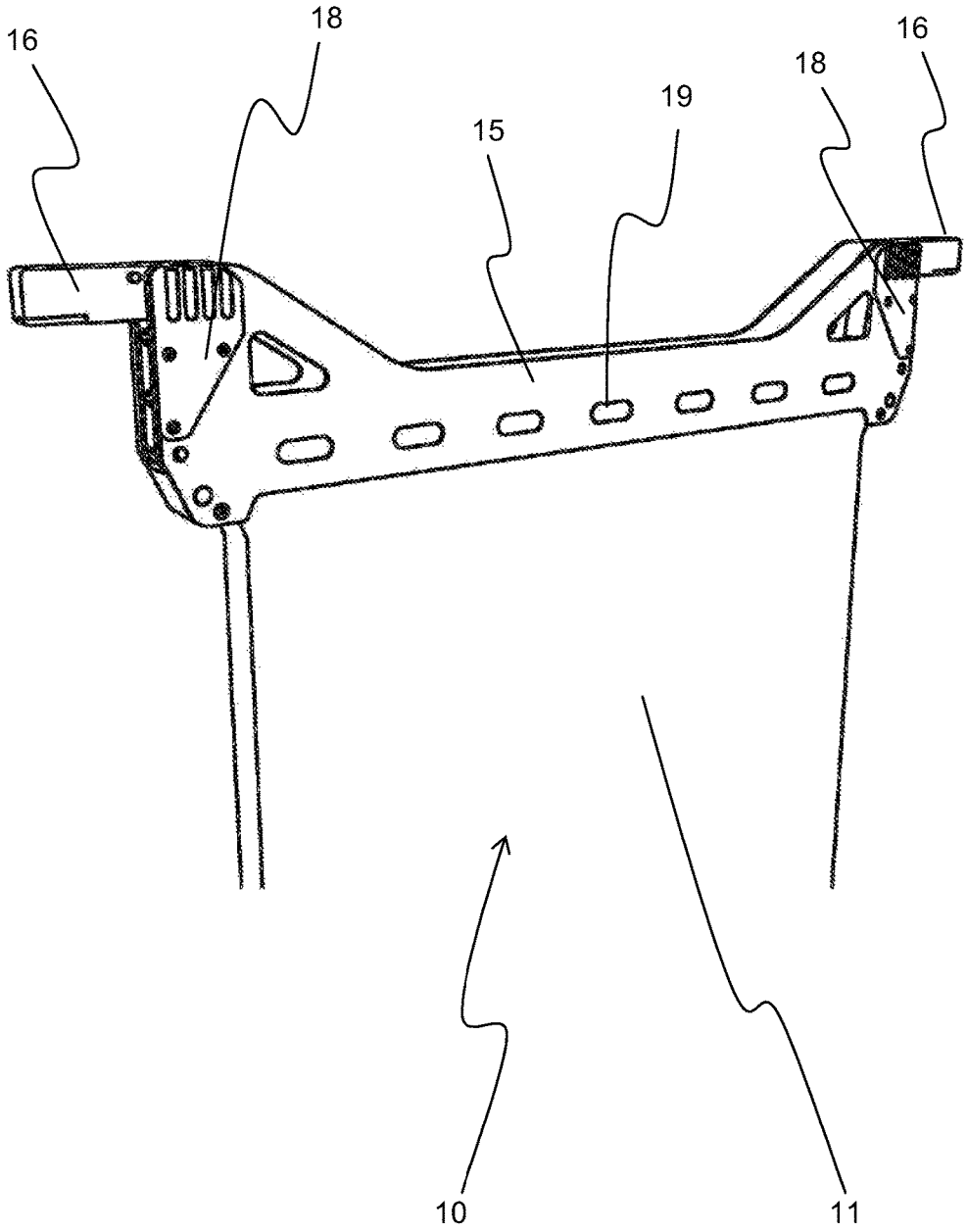
FIG. 15 shows a front upper perspective view of the complete insertion of an anode of the present invention into a hanging bar of the present invention wherein the bar has the lugs in a closed position.
Figure 16:
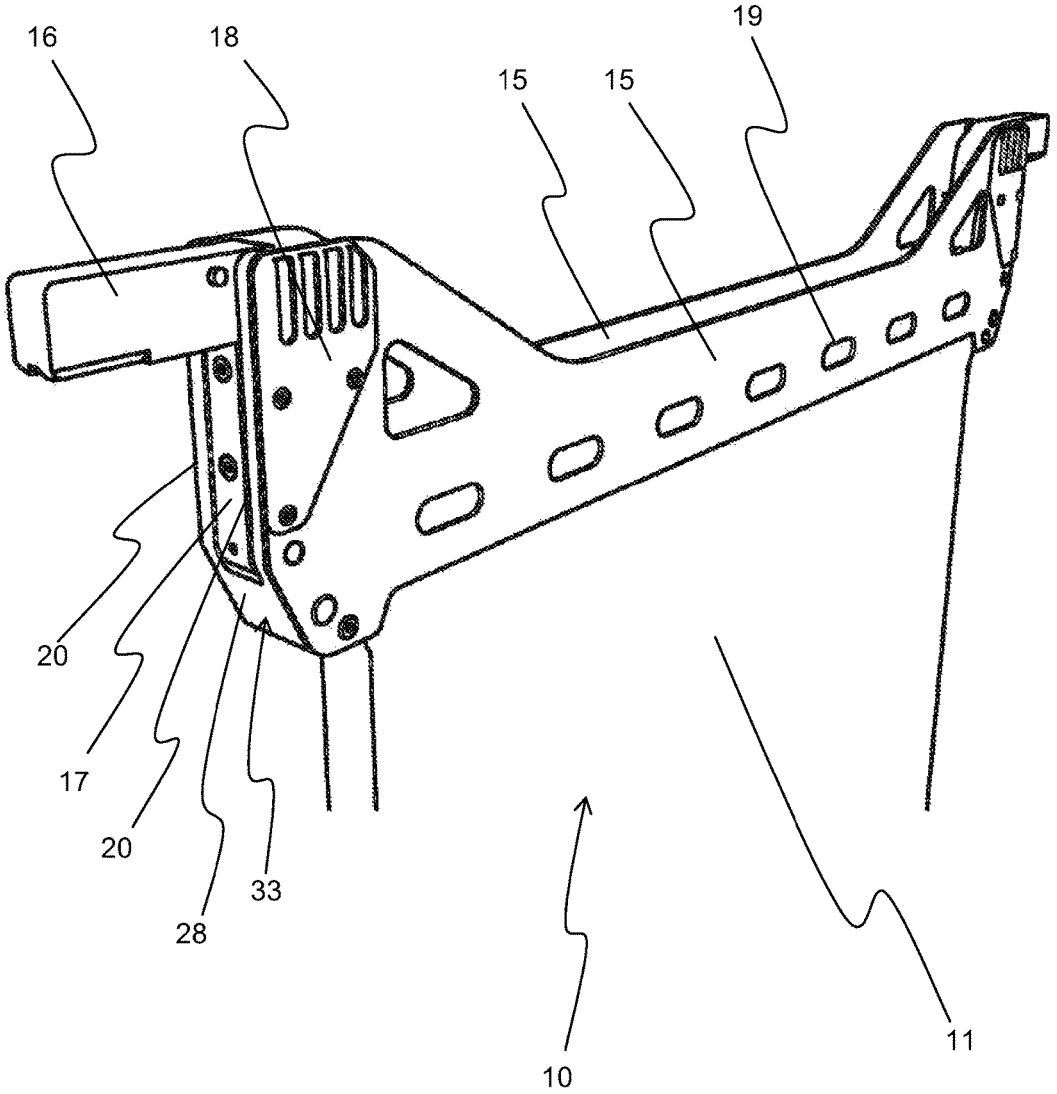
FIG. 16 shows a side upper perspective view of the complete insertion of an anode of the present invention into a hanging bar of the present invention wherein the bar has the lugs in a closed position.
Figure 17:
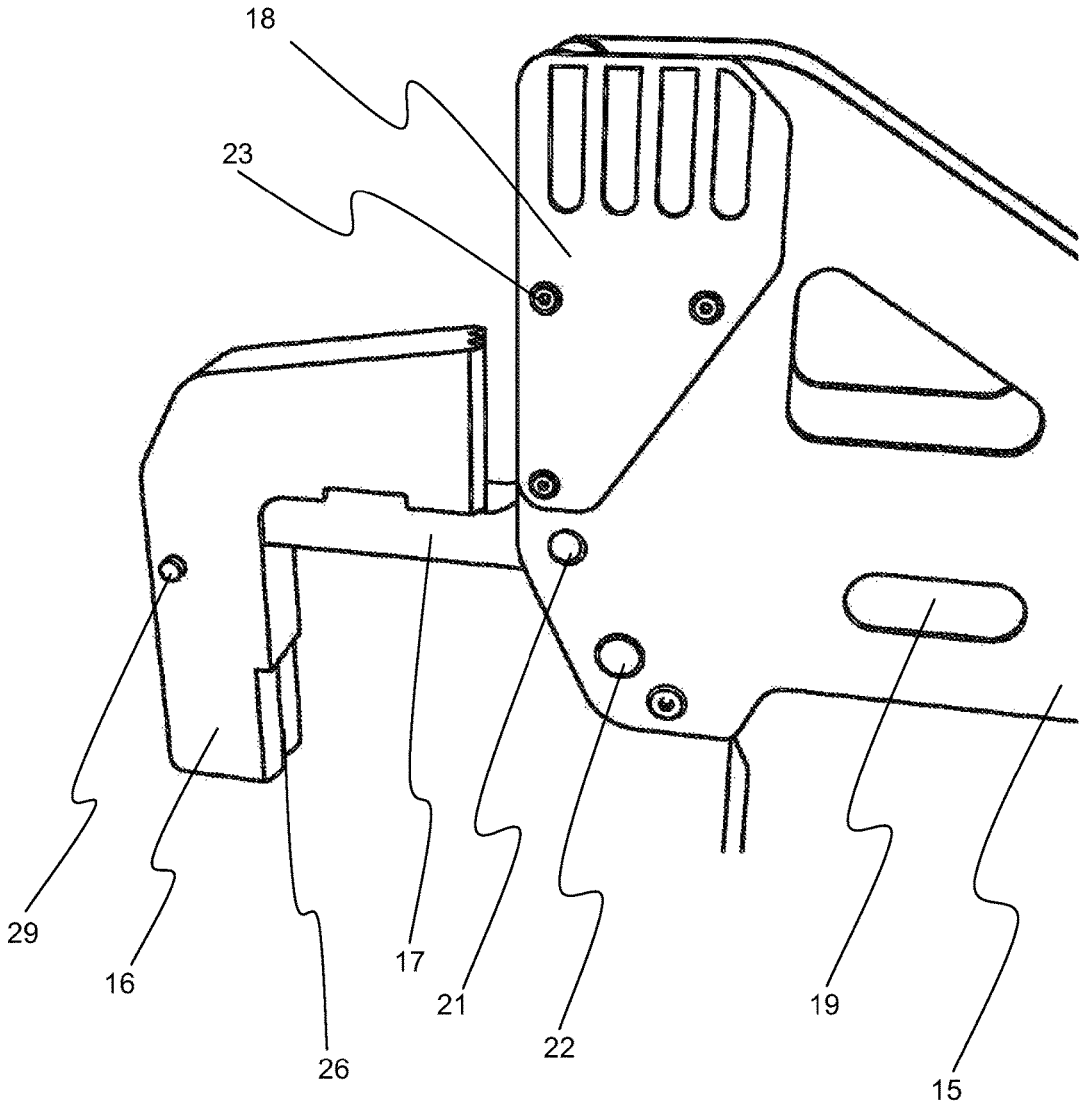
FIG. 17 shows an exploded perspective view of a lug of the hanging bar of the present invention in an open position.

In reference to FIG. 8, the anode (10) of the present invention is formed by first lower portion of the body (11) and a second upper hanging portion (12). The lower portion of the body (11) has a rectangular parallelepiped straight thin shape and the second upper hanging portion (12) has a shape of an inverted flattened trapezium wherein its side edges generate first inclined surfaces (13) being the height of the lower portion of the body (11) and the height of the second upper hanging portion (12) in an approximate relationship of 10:1.

Also, the present invention relates to a hanging bar (14) with pivotable lugs (16) to support the anode (10).

According to what has been illustrated in FIGS. 9 to 16, said hanging bar (14) is formed by two elongated splints (15) having a similar width to the width of the upper hanging portion (12) of the anode (10) and having a plurality of holes (19) to facilitate the transition of the electrolyte towards said second hanging portion (12) of the anode (10). Both splints are separated from each other by a distance similar to the thickness of the anode (10) leaving an appropriate interstice for said anode (10) to slide in its interior.

Said distance is secured by a spacer plastic piece (33) which is formed by a base (28) from which two pillars (20) emerge, leaving between both pillars (20) a central housing zone (34) for the pivoting support (17) when this is in closed position. At each end of the pair of elongated splints (15) are located said spacer plastic pieces (33) which are joined to said pair of elongated splints (15) by a spacer pin (22) and a plurality of screws (24). The ends of the pair of splints (15) are reinforced by plates (18) attached by means of a plurality of screws (23).

On the base (28) and between both pillars (20) there is a planar surface (31) on which a bushing is supported against (27) which is an integral part of a straight piece (43) forming said bushing (27) and straight piece (43) a pivoting piece (17) which supports the pivoting lug (16). The center of the bushing (27) has a first hole (39) which matches the second holes (38) of the pillars (20) and third holes (40) of the elongated splints (15) in such a way that within the holes (38, 39, 40) a short axis (21) is housed wherein it pivots the pivoting support (17). When the anode (10) is in contact with the hanging bar (14), the base (28) of the spacer plastic piece (33) laterally has a second inner inclined surface (30) which is fitted in and supports the first inclined surface (13) of the anode (10) thereby generating a wedging means.

Said pivoting lug (16) is formed by a first elongated portion (36) and a second short portion (37) integrally connected to each other at 90, providing an L shape in open position oriented in an inverted vertical way and when in a closed position, it is oriented in a laid horizontal way.

The first portion (36) is aimed to make contact with the contact bar (6) of the electrolytic cell (3) by means of the first toothed notches (26) to guarantee a good electrical contact.

The second short portion (37) is aimed to make contact with the upper edge (32) of the anode (10) by means of the second toothed notches (25) in order to guarantee a good electrical contact.

The pivoting support (17) and the pivoting lug (16) are connected to each other by means of screws (35) and also by means of a male projection (41) located on the pivoting support (17) and a female cavity (42) located on the short portion (37) of the pivoting lug (16) thereby forming a tongue and groove joint (41, 42). On the outer faces of the first portion (36) of the pivoting lug (16) there are projections (29) designed to demarcate the path of the lug when passing from the open position to the closed position.

Figure 18:
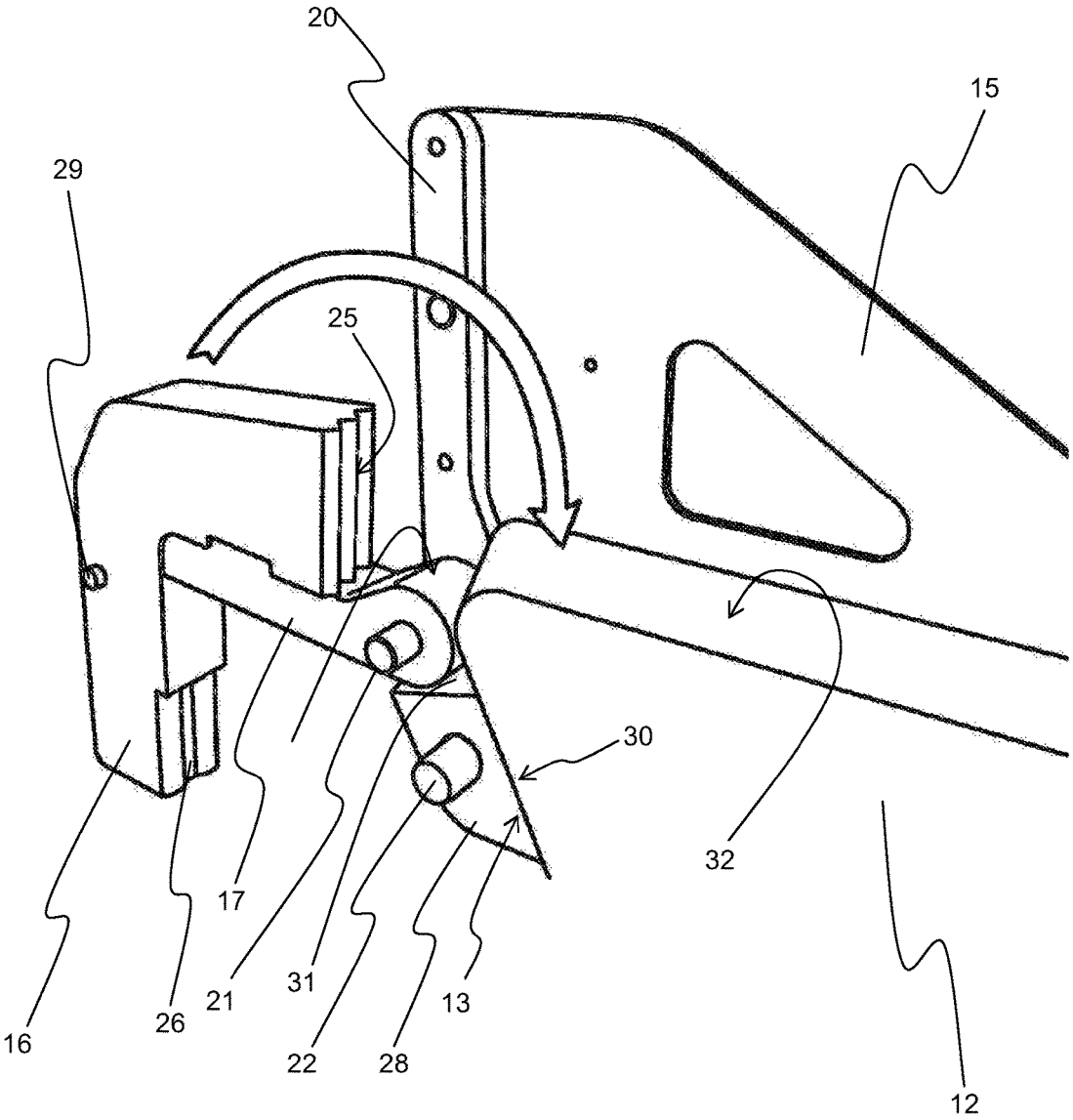
FIG. 18 shows an exploded perspective section view of the pivoting mechanism of a lug of the hanging bar of the present invention in an open position.
Figure 19:
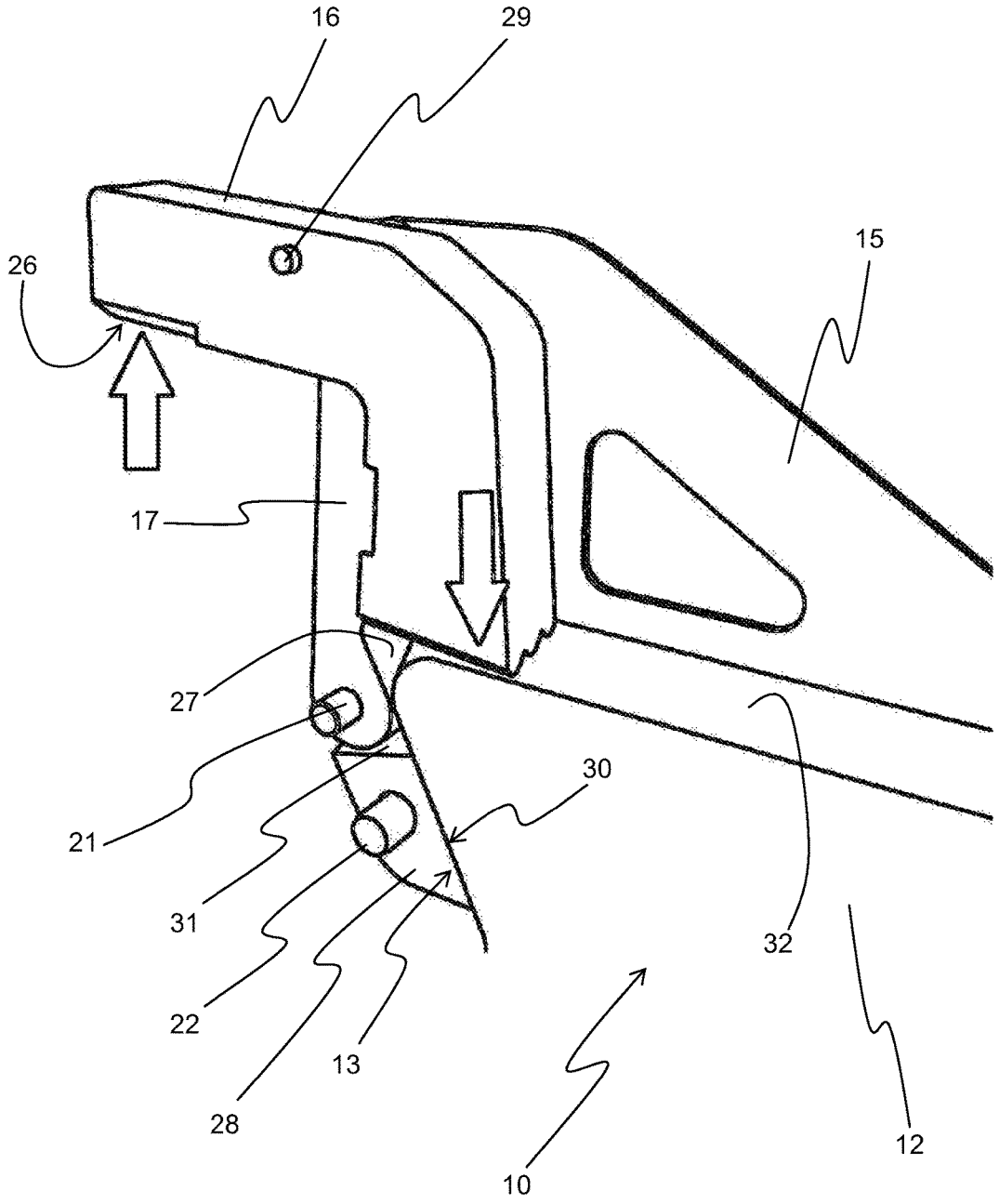
FIG. 19 shows an exploded perspective section view of the pivoting mechanism of a lug of the hanging bar of the present invention in a closed position.
Figure 20:
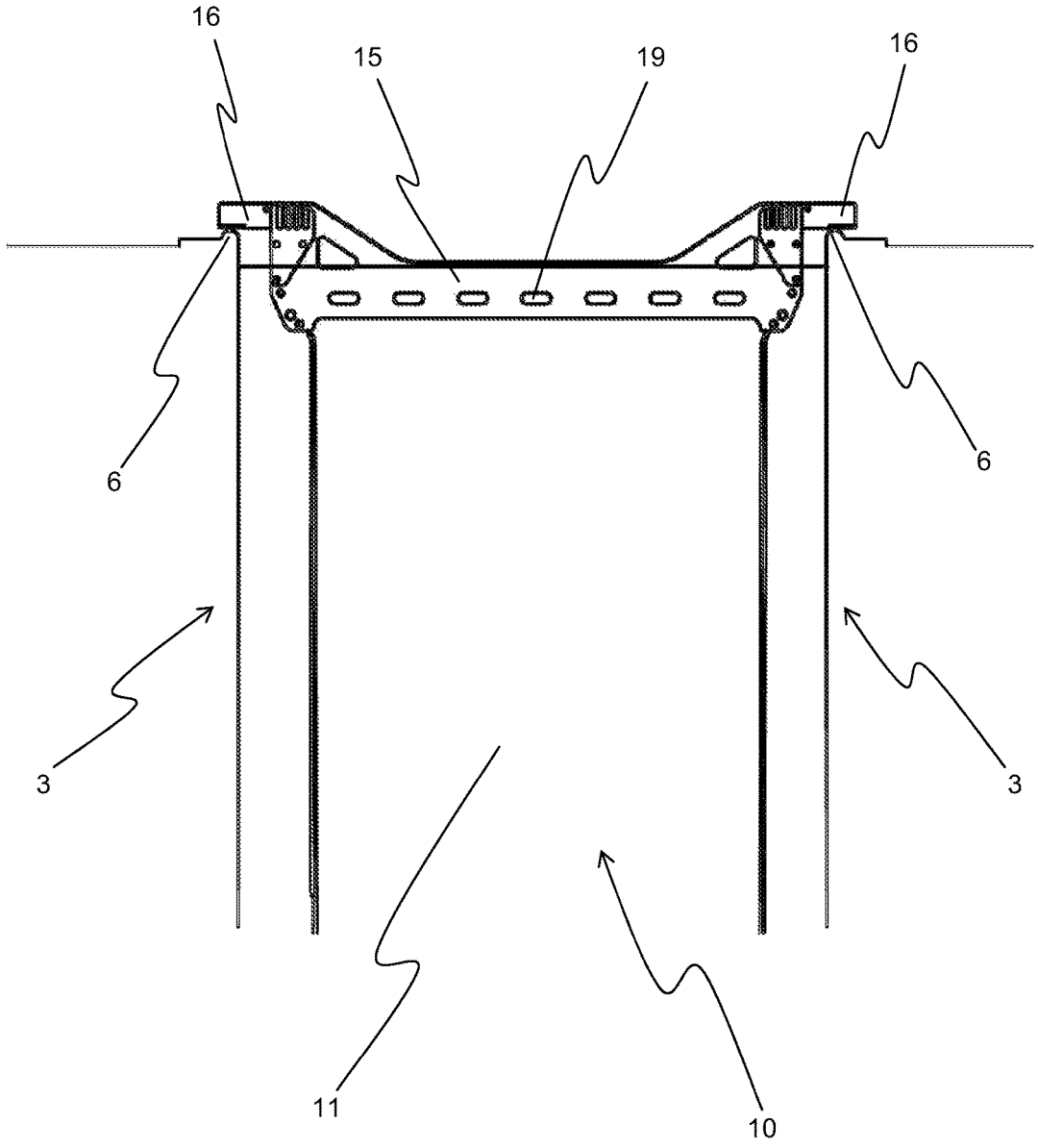
FIG. 20 shows a front view of an anode of the present invention with the hanging bar of the present invention within an electrolytic cell.

FIGS. 18 and 19 show a front perspective cut view describing the pivoting system of the pivoting lug (16) and the pivoting support (17). When the pivoting lugs (16) and the pivoting supports (17) are in an open horizontal position, they leave free access to the anode (10) towards the interstice produced between the splints (15) so as said anode (10) is slid in its interior and the first inclined surface (13) of said anode (10) makes total contact with the second inclined surface (30) of the base (28) of the plastic spacer piece (33). When the first inclined surface (13) of the second upper hanging portion (12) of the anode (10) is butted with the second inclined surface (30) of the base (28) of the plastic spacer piece (33), the anode (10) is secured with which is possible to close the pivoting lugs (16) by moving them towards its vertical position leaving the anode (10) ready to be conveyed and introduced into an electrolytic cell (3) as shown in FIG. 20.

The invention claimed is:

1. A system characterized in that said system comprises:

(a) an anode without lugs having a body with a first lower portion and a second upper hanging portion, wherein said first lower portion of the body has a rectangular parallelepiped straight thin shape having a first height and the second upper hanging portion of the body has a shape of an inverted flattened trapezium with side edges that provide inclined surfaces having a second height, said first height of the lower portion of the body being substantially greater than said second height of the second upper hanging portion of the body in an approximate relationship of 10:1; and (b) a hanging bar to support said anode, said hanging bar being formed by:

two elongated splints, each having two ends and separated from each other by a distance greater than a thickness of the said anode, leaving an appropriate interstice for said anode to slide between said elongated splints;

two plastic spacer pieces connecting the ends of said two splints, each one of said plastic spacer pieces being formed by a base with two pillars and a central housing zone located between said two pillars, wherein on said base and between said pillars there is a planar surface and on an inner portion of said base there is an inclined surface;

two pivoting supports, each one of them housed in the central housing of said two plastic spacer pieces, wherein said pivoting supports are formed by a straight piece, wherein each straight piece has a bushing with a center that defines a first hole, said pillars define second holes, and said elongated splints define third holes, such that said first hole coincides with the second holes of one of said pillars and with the third holes of one of said elongated splints in such a way that within said holes a short axis is housed wherein said pivoting supports pivot; and a pair of pivoting lugs which are supported by said pivoting supports, each pivoting lug formed by a first elongated portion and a second short portion integrally connected to each other at 90°, providing an L shape, wherein said first elongated portion has first toothed notches and, wherein said second short portion has second toothed notches.

2. A system as claimed in claim 1 characterized in that said elongated splints have a plurality of holes to make easier the transition of the electrolyte towards said second hanging portion of the anode.

3. The system as claimed in claim 2 characterized in that said elongated splints and said plastic spacer pieces are connected by a spacer pin and a plurality of screws.

4. The system according to claim 3 characterized in that said elongated splints have plates which are attached by means of a plurality of screws to the ends of the elongated splints.

5. The system according to claim 1 characterized in that one of said pivoting support and one of said pivoting lug are connected by means of screws and also by means of a male projection located on said pivoting support and a female cavity located on the short portion of the pivoting lug forming a tongue and groove means.

6. The system according to claim 1 characterized in that said first elongated portion of the said pivoting lug has outer faces with projections aimed to demarcate the path of the lug.

* * * * *